United States Patent [19]

Cruz

[11] 4,095,452

[45] Jun. 20, 1978

[54] CAN BODY STRIPPER

[75] Inventor: Fred Cruz, Westminster, Colo.

[73] Assignee: West Mark Denver, Inc., Denver, Colo.

[21] Appl. No.: 748,164

[22] Filed: Dec. 7, 1976

[51] Int. Cl.[2] ..... B21D 45/00

[52] U.S. Cl. ..... 72/344; 72/427

[58] Field of Search ..... 72/344, 345, 346, 361, 72/427

[56] References Cited

U.S. PATENT DOCUMENTS

| | | | |
|---|---|---|---|
| 2,345,857 | 4/1944 | Newell | 72/344 |
| 2,369,260 | 2/1945 | Slater | 72/346 |
| 2,528,577 | 11/1950 | Catlin et al. | 72/344 |
| 2,901,995 | 9/1959 | Lavigne | 72/344 |
| 3,359,775 | 12/1967 | Langewil | 72/344 |
| 3,664,171 | 5/1972 | Paramonett | 72/344 |
| 3,886,781 | 6/1975 | Poramonett | 72/427 X |
| 3,955,394 | 5/1976 | Kaufman et al. | 72/344 |

*Primary Examiner*—Leon Gilden

*Attorney, Agent, or Firm*—Kyle W. Rost

[57] ABSTRACT

An inner ring supports a plurality of stripper segments in nonabutting relationship, bosses on the outer surface of the ring both spacing the segments and retaining them in predetermined positions on the circumference of the ring. Each segment has a stripping edge formed by the intersection of a forward segment face and a radially inward segment face, the latter face having an arc of greater radius than the radius of the metal object being stripped. The outer surface of the ring has a chamfered forward edge and a recess at the rear edge to allow the segments to pivot easily when deflected.

3 Claims, 5 Drawing Figures

CAN BODY STRIPPER

BACKGROUND OF THE INVENTION

1. Field of the Invention

The invention relates to metal deforming, class 72-344, and to metallic can body strippers.

2. Description of the Prior Art

In the metal forming art it has long been known that metal objects can be formed from a metal blank by forcing the blank through a series of ironing dies under the force of a ram. Such a process is used to form the well known one-piece aluminum can body and similar machinery has previously been used to form shell casings as disclosed in U.S. Pat. No. 2,345,857 to Newell, and to draw tubing as disclosed in U.S. Pat. No. 2,369,260 to Slater.

After the metal object has been formed, it is tightly engaged on a punch attached to the end of the ram and must be removed as the ram retracts through the ironing dies. For this purpose, strippers have long been used. A stripper is usually a complete ring composed of wedge-shaped segments machined to fit together with perfectly abutting sides, a resilient retainer ring or garter spring passing around the outer circumference of the segment ring to hold the ring intact using the well known keystone concept. The diameter of the inner opening of the ring is slightly larger than the diameter of the ram so that the ram may pass through the stripper ring without contact, but the inner diameter of the ring must be carefully machined to engage the edge of the thin wall of the metal object on the punch as the ram retracts through the stripper. In this way, the stripper holds the metal object as the ram retracts and thereby strips the object from the punch. However, the shape of the segments is such that the ram and metal blank can deflect the segment edges and pass through the stripper during the ram's forward motion while forming the metal object.

The Slater patent discloses a special contour of each segment that avoids scratching the metal object during the ram's forward motion through the stripper. In addition U.S. Pat. No. 3,664,171 to Paramonoff and U.S. Pat. No. 3,735,628 to Hutchinson teach improved pivoting of segments during forward motion of the ram.

In the prior art, stripper segments have been supplied in matched sets for perfect fit between segments. When the segments are circumferentially adjacent, an exact fit is needed so that no segment scores the punch and so that each segment carries its share of the stripping work. When the stripping edge of the segments wears to the point of needing adjustment in order to properly catch the edge of the metal object being stripped, the job requires that each segment be machined to retain perfect circumferentially adjacent fit between segments of a set while reducing the inner diameter of the set by the precise needed amount. This adjustment task is extremely expensive and exacting.

Another problem in the prior art is that segments often fail at the corners of the stripping edge. When a corner breaks, the segment must be either remachined and accordingly the entire set remachined, or discarded, and accordingly the entire matched set discarded. Thus, the requirement for segments to be circumferentially adjacent or in a matched set leads to excessive costs when a single segment fails. All four of the above named patents call for circumferentially adjacent segments, and the Paramonoff and Hutchinson patents describe an additional retainer ring structure that allows no adjustment for segment wear or damage.

A related problem in the prior art is that segments in a matched set are often individually machined from bar stock. The weakest part of the bar is the outer portion, which is the part used for the segments, while the stronger center of the bar is machined away. As a result, the segments of a matched machined set are overly subject to failure because the weakest part of the bar stock was used for their manufacture. When a segment corner fails, the resulting sharp edge may damage the punch and score numerous formed objects being stripped from the punch before the failure is detected, creating a long reaching problem of quality control.

Obtaining rapid segment pivoting is another problem in the art. The speed of a can body former may be limited by the speed with which the segments can close against the punch after being deflected by the punch and its carried can body. Abutting segments create friction between their adjacent sides when they are deflected on the forward stroke of the ram, and if the segments have not closed when the ram retracts, the formed can body will remain on the punch and a second can will be formed over the first. If a plurality of cans accumulates on the punch, the machine may suffer damage and the machine must be stopped for removal of the cans from the punch.

SUMMARY OF THE INVENTION

A stripper for use in a can body former or the like has a plurality of individually cast segments that may be combined without regard to sets and without the need to match the segments in a circumferentially adjacent configuration. The segments are mounted on an inner ring that includes spacing means for holding each segment in its proper position on the ring, and a resilient annular retainer or garter spring holds the segments against the inner ring. Each segment has a machined stripper edge having an arc of slightly larger radius than the radius of the can body or like object being stripped from a punch, the larger radius resulting in less stress being on the corners of the stripper edge and accordingly reducing corner failure in the segments.

An object of the invention is to create a stripper that does not require a matched set of segments. The present invention uses an inner ring to support the segments at the proper diameter to catch the edge of a can body to be stripped from a punch. The need for each segment to be machined to fit each adjacent segment and at the same time to form a ring of an exact inner diameter is eliminated. The sides of the present segments require no machining and may be as cast. The segments need not be circumferentially adjacent, as the keystone concept of the prior art is not used to hold the segments in a ring. Rather, the inner ring has spacing means to hold each individual segment in its proper position in the ring.

Another object is to eliminate the need to machine the sides of each segment when the segments of the stripper have worn to an overly large inner diameter. Because the segments do not use the keystone concept to determine the size of the ring, the inner diameter of the ring may be reduced by machining the outer surface of the inner ring. The outer diameter of the ring is thereby reduced, reducing the inner diameter of the stripper itself when the original segments are returned to the remachined ring. The time and cost of returning a worn stripper to duty is substantially reduced, and the level of skill required to reduce the outer diameter of a ring is far less than that required to machine the adjacent sides of a set of segments so that the segments will form a perfect circle of circumferentially adjacent members, as in the prior art.

An important object is to eliminate failure of individual segments through broken corners of the stripper edges. The weakest parts of the stripper edge of each segment are the corners, but in the prior art they have done equal work with the center of the stripper edge. The present invention has a stripper edge with a larger diameter than the diameter of the can body being stripped. As a result, the corners of the stripper edge are under less stress and are less subject to failure. Furthermore, the present segments may be cast substantially in their final shape, with only minor machining being required. A cast object is usually stronger than one machined from metal bar stock. Accordingly, the basic cast segment will be stronger than prior art machined segments because the molecular structure of the cast object is not disrupted by extrusion.

Another important object is to create a stripper that can operate as fast as the ram of any known can body maker. By eliminating the problem of friction between abutting segments, the present stripper segments will close as rapidly as known can forming machines can move the punch forwardly and rearwardly through the stripper. The segments are nonabutting and do not mutually interact to create pivoting problems. Rather, each segment is supported on the outer face of a ring and is held in place laterally by a pair of bosses, the adjacent sides of the bosses being preferably parallel to the sides of the segment, and the sides of the segment being mutually parallel. Thus, pivoting creates no relative change in the angle between the segment and the sides of the bosses, making the segments extremely fast in closing after being deflecting on the forward stroke of the ram.

DESCRIPTION OF THE PREFERRED EMBODIMENT

Figure 5:
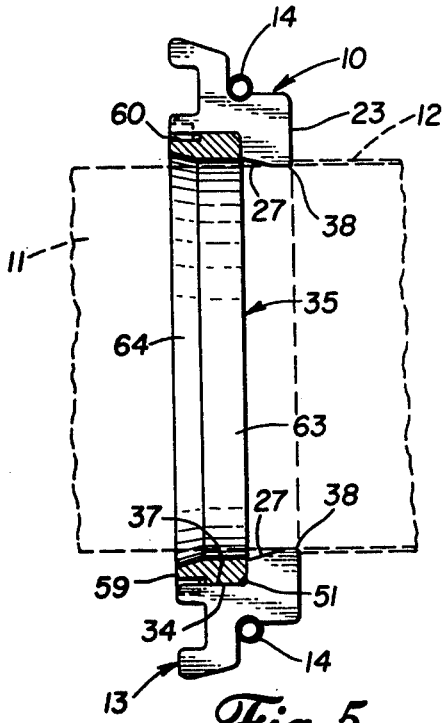
FIG. 5 is a side sectional view of the stripper taken along the plane 5—5 of FIG. 4, and showing the segments in closed position on a punch for stripping a formed can body.

The stripper 10 is used in a can body former or the like having a ram with a punch 11 on its forward end that pushes a metal blank through an ironing die, the metal blank becoming firmly attached to the punch as the ram passes forward through the die. Near the end of its travel, the ram and attached metal object, for example a cylindrical can body 12, pass through the stripper, deflecting the individual segments 13 to create an opening of slightly increased diameter as the punch and metal object pass forwardly through the stripper. When the metal object on the ram has fully passed through the stripper, the segments 13 return to their original undeflected position, for example under force of outer retainer spring 14, and the diameter of the stripper opening is correspondingly reduced. In the latter closed position, the diameter of the stripper opening is quite close to the diameter of the punch so that as the ram retracts, the stripper segments will lightly touch the surface of the punch and will engage the edge of the metal object on the punch, as shown in FIG. 5, and hold the object in a stationary position as the ram retracts, freeing the punch of the object. This general operation of a stripper is well known in the prior art.

Figure 1:
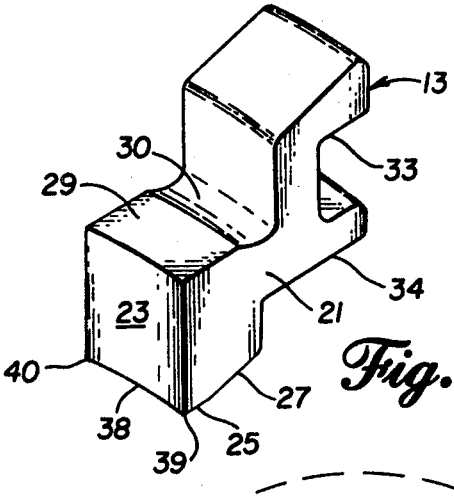
FIG. 1 is a perspective view of a single stripper segment.
Figure 2:
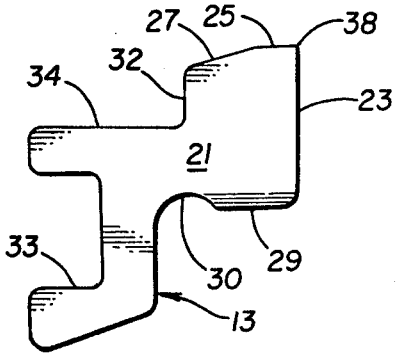
FIG. 2 is a side view of a stripper segment.
Figure 3:
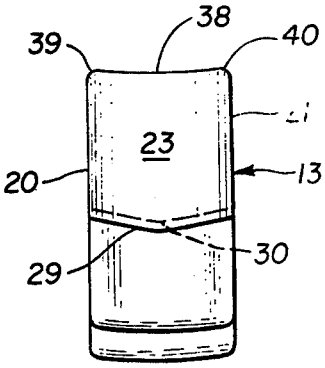
FIG. 3 is a front view of a stripper segment.
Figure 4:
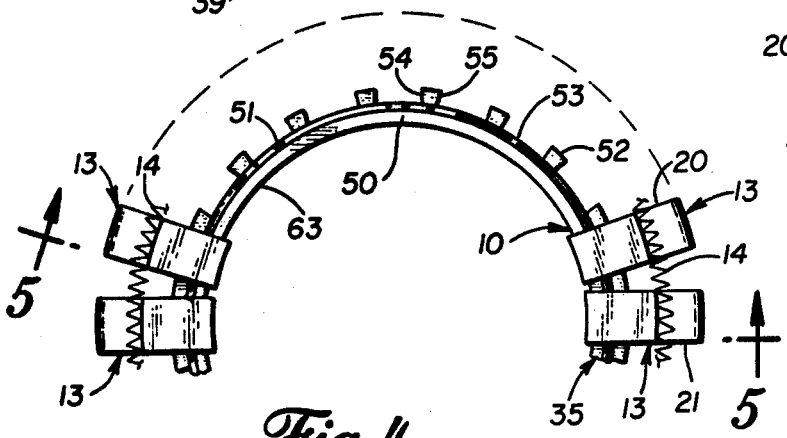
FIG. 4 is a front elevational view of the stripper showing the relationship between the ring, segments, and retainer spring.

As shown in FIGS. 1–3, each segment 13 has sides 20 and 21; front face 23; inward faces 25 and 27; outward face 29 having groove 30, and rear face 32. In addition, each segment has a rearward extending portion 33 whose shape is variable for the exact machine in which the stripper 10 will be used, but portion 33 will include inwardly facing side 34 for contacting the outer surface of inner ring 35, as shown in FIGS. 4 and 5, and supporting the segment 13 against ring 35.

Each segment may be formed in any convenient manner with casting being the preferred method offering economy and ease of manufacture, as well as excellent strength for the finished segment. When a finished segment is mounted on inner ring 35 in undeflected position as shown in FIGS. 4 and 5, side 34 will be substantially parallel to the outer surface 37 of the inner ring and also substantially parallel to the axis of the stripper 10. Sides 20 and 21 may be mutually parallel and also parallel to the stripper axis, although the exact angle of these sides is not critical because the segments 13 are not circumferentially adjacent around ring 35. However, sides 20, 21 have some interaction with portions of ring 35 as will be described below, and accordingly should be relatively smooth with a mutually parallel relationship between the sides being the preferred configuration for each segment. Rear segment face 32 is connected to side 34 and preferably is perpendicular to the stripper axis, although the angle is not critical. Outward face 29 is contoured to angle radially inwardly as it approaches sides 20, 21 from the axially parallel center line of face 29, for example at ten degrees to a plane tangent to the center line of face 29, providing a convenient spot 30 near the center line of face 29 for fixturing the segments for machining.

If segment 13 is cast, the only faces that require machining are 23, 25, and 27. Front face 23 directly contacts the can body 12 on the punch 11 during the stripping operation, as shown in FIG. 5, making it desirable for all faces 23 to be substantially in a single plane. Accordingly, face 23 is preferred to have a smooth and uniform flat contour.

Immediately adjacent to the radially inward stripping edge 38 of face 23 is face 25, which is finished in an arc having radius larger than the radius of the can body being stripped from the punch. For example, when stripping a can having an outer radius of 1.42 inches, the radius of the arc of face 25 may be 1.60 inches, resulting in reduced pressures on corners 39 and 40 during the stripping operation as contrasted to the pressures if the arc of face 25 were of the same radius as the can. Consequently, the strong central portion of edge 39 does most of the stripping work and the life of each segment is increased. The exact radius of the arc on face 25 may be empirically determined for various can body sizes. Face 25 is angled radially outwardly and axially rearwardly by a small amount, for example 1.5° from the stripper axis. This small angle assures that edge 38 will remain the part of face 25 contacting the punch during the can stripping operation, despite normal wear on edge 38.

Face 27 runs between face 25 and rear face 32 and angles radially outwardly and axially rearwardly at a greater angle then face 25, for example at 15° to the stripper axis. The can body 12 on punch 11 strikes face 27 during its forward motion to cause deflection of the segments, the can body 12 on the punch sliding axially along face 27 during the deflection. Accordingly, face 27 is machined to an arc that will allow the smooth passage of the ram and its carried metal object, as is well known in the art.

Inner ring 35 serves as a base for supporting a plurality of segments 13, for example 20 segments. The segments rest with portion 34 contacting the radially outward face 37 of ring 35, forward face 23, inward faces 25 and 27, and rear side 32 of segment 12 extending over forward ring face 50. The intersection of face 50 and face 37 preferably is chamfered at 51, for example at 45°, to allow easy pivoting of segments 13 in response to deflection by the can body on the punch. Spacing means, for example projecting bosses 52, extend at spaced intervals in a radially outward direction from face 37, and also serve as means for retaining the non-abutting segments in proper distribution around ring 35. Between the bosses are segment-receiving gaps 53, the width of each gap being slightly greater than the width of a segment, for example by 0.010 in. Each boss has a side 54 adjacent a first segment and a side 56 adjacent a second segment, each boss side being parallel to the adjacent segment side.

The bosses preferably are at the rear of face 37 and terminate rearwardly in the plane of rear ring side 59. In each gap 53 between bosses 52, outward face 37 contains recess 60 radially below the level of face 37 and running axially forwardly from rear side 59 to slightly beyond the forward most part of bosses 52, for example 0.025 inches toward face 50 beyond the bosses. The presence of recess 60 between the bosses allows face 37 to be machined without leaving a raised portion between the bosses that would interfere with the proper fit of the segments in the segment gaps 53.

A stripper 10 may be assembled from a ring 35 and a plurality of segments 13, not necessarily from a matched set, as the segments do not abut in a continuously adjacent relationship. One segment is placed in each gap 53 and resilient retainer means such as garter spring 14 is placed around the segments to urge them into closed position and maintain them in gaps 53. An outer retaining ring, as is well known in the prior art, may encircle the inner ring and segments mounted thereon. The complete stripper 10 is then placed in the can body forming machine in axial alignment with the path of the ram and punch. The stripper may be floatably mounted in the machine, thereby allowing the stripper to be self-aligning with the ram. Inner side 63 of ring 35 may be chamfered at its intersection with rear side 59, creating radially outwardly, axially rearwardly extending wall 64 at the rear of side 63. The shape of wall 64 makes stripper 10 self-aligning with the punch as the punch moves through the stripper from rear to front on the forward stroke of the ram. When the can body on the punch reaches the forward end of ring 35, it strikes segment faces 27 and deflects the segments, each segment pivoting along side 34 against ring face 37 as the rear part of side 34 pivots into ring recess 60. When the portion of the punch carrying the can body has passed through the segments, retainer spring 14 urges the segments to pivot back to closed position, bringing stripping edges 38 against the punch. As the ram retracts, edges 38 engage the lip of the can body and hold the can body in stationary position as the ram continues to retract, freeing the punch of the formed can body, which then falls away from the stripper.

Wear on segment edges 38 is repaired by removing the segments and machining faces 23, 25 and 27 as required, maintaining the uniformity of stripping edges 38. Ring face 37 is then ground to reduce the outer diameter of the ring, in turn reducing the inner diameter of the stripper opening to compensate for wear and regrinding of the segments. Segment sides 20, 21 never require machining for the purpose of fitting the segments back into the ring 35, as grinding of ring side 37 accomplishes the entire job of bringing segment edges 38 radially closer to the surface of the ram. Similarly, if one segment in a stripper should fail, a replacement may be substituted by machining only sides 23, 25 and 27 of the new segment to match the remaining segments.

I claim:

1. An improved stripper of the kind used in can body formers or like machines wherein a punch carries a cylindrical can body through a ring of stripper segments resiliently held in place and deflectable under forward motion of the punch, resilient means urging the segments to return to undeflected position, and wherein the punch moves rearwardly through the stripper segments with the segments contacting the surface of the punch and engaging an edge of the can body, holding the can body in place as the punch retracts from the can body, the improvement comprising:

(a) a stripper segment support ring forming an inner opening of larger diameter than a punch adapted to pass therethrough, the ring having a radially outward facing surface, a radially inward facing surface, a forward wall joining the inward facing surface to the outward facing surface, and a rear wall joining the inward facing surface to the outward facing surface at the axially opposite end of the ring from said forward wall;

(b) a plurality of stripper segments supported on said outward facing surface in spaced, mutually non-abutting relationship;

(c) a plurality of bosses integral with said ring and spaced at circumferentially aligned predetermined locations about the circumference of the ring, the bosses extending radially outwardly beyond said outward facing surface of the ring, each boss separating two of said segments, the bosses maintaining the segments in circumferentially fixed locations about the ring;

(d) said support ring having a void area located at and below the level of said outward facing surface circumferentially between said bosses for allowing reduction of the outer diameter of said ring at said outward facing surface without requiring reduction of the diameter of material circumferentially between said bosses, the void area being a recess at the junction of the rear wall and the outward facing wall;

(e) each of said stripper segments having a stripping edge and having an inwardly facing side contacting said outwardly facing side of the ring and pivotally supporting the segment against the ring, each segment having a portion of its inward facing side extending over said recess and being pivotable therein, the bosses extending radially outwardly from the recess and separating the portions of the segments extending over the recess, said stripping edge depending radially inwardly over said forward wall from the inwardly facing side of the segment, the stripping edges of each of the segments defining a stripper opening of smaller diameter than the inner diameter of the ring for stripping a can body from a punch moving rearwardly through the stripper opening.

2. An improved stripper of the kind used in can body formers or like machines wherein a punch carries a cylindrical can body forwardly through an ironing die to produce a predetermined outer radius on the can body, the punch then carrying the can body axially forwardly through a ring of stripper segments resiliently held in place and deflectable under forward motion of the punch and the can body carried thereon, resilient means urging the segments to return to undeflected position after the can body has passed therethrough and to contact a radially inward segment face against the surface of the punch rearwardly of the can body, and wherein the punch then moves axially rearwardly through the stripper with an axially forward segment face contacting the rearward edge of the can body on the punch and holding the can body in place while the punch retracts rearwardly from the can body, wherein the improvement comprises:

said radially inward punch-contacting segment faces each having a concave arc of greater radius than the radius of the punch; and thereby defining a stripping edge having an arc of greater radius than the predetermined outer radius of the can body, the relatively greater radius of the arc of the stripping edge as compared to the radius of the can body causing the center of the stripping edge to bear more stripping forces than the corners of the stripping edge.

3. An improved stripper according to claim 2 wherein the radius of said concave arc is on the order of about 0.12 greater than the inner diameter of the ironing die which produces the predetermined outer diameter of the can body.

* * * * *